US007640632B2

(12) United States Patent
Lazarus

(10) Patent No.: US 7,640,632 B2
(45) Date of Patent: Jan. 5, 2010

(54) ARTICLE FOR HOLDING CURRENCY AND CREDIT CARDS

(75) Inventor: Jeffrey Lazarus, Villanova, PA (US)

(73) Assignee: Bella J LLC, Villanova, PA (US)

( * ) Notice: Subject to any disclaimer, the term of this patent is extended or adjusted under 35 U.S.C. 154(b) by 0 days.

(21) Appl. No.: 12/174,657

(22) Filed: Jul. 17, 2008

(65) Prior Publication Data

US 2009/0094795 A1 Apr. 16, 2009

Related U.S. Application Data

(63) Continuation-in-part of application No. PCT/US2007/081050, filed on Oct. 11, 2007.

(51) Int. Cl.
*A45F 5/00* (2006.01)
*B65D 63/00* (2006.01)

(52) U.S. Cl. ..... 24/17 B; 24/303; 150/143

(58) Field of Classification Search ..... 24/3.11, 24/3.12, 3.6, 303, 17 R, 17 A, 17 B; 224/250, 224/901, 253, 226; 150/143
See application file for complete search history.

(56) References Cited

U.S. PATENT DOCUMENTS

| | | | |
|---|---|---|---|
| 702,398 | A | 6/1902 | Bowyer |
| 738,462 | A | 9/1903 | Lincoln |
| 2,892,228 | A | 6/1959 | Peterson |
| D275,815 | S | 10/1984 | Dillenno |
| D275,825 | S | 10/1984 | Kates |
| 4,759,963 | A | 7/1988 | Uso, Jr. et al. |
| 4,881,684 | A | 11/1989 | Chinman |
| 5,077,869 | A | 1/1992 | Haase |
| 5,104,076 | A | 4/1992 | Goodall, Jr. |
| 5,152,035 | A | 10/1992 | Morita |
| 5,174,483 | A | 12/1992 | Moore, IV et al. |
| 5,279,019 | A | 1/1994 | Knickle |
| 5,325,991 | A | 7/1994 | Williams |
| 5,459,905 | A | 10/1995 | Voyre |
| 5,533,656 | A | 7/1996 | Bonaldi |
| 5,535,928 | A | 7/1996 | Herring |
| 5,881,436 | A | 3/1999 | Lyons |
| 5,941,434 | A | 8/1999 | Green |
| 6,145,715 | A | 11/2000 | Slonim |
| 6,357,084 | B1 | 3/2002 | Haidon |

(Continued)

*Primary Examiner*—James R Brittain
(74) *Attorney, Agent, or Firm*—Michael B. Fein; Cozen O'Connor

(57) ABSTRACT

An article for holding currency and credit cards is disclosed which comprises (a) a first length of substantially non-stretchable material having a first end and a second end configured to form a closed flat loop when the first end is retained on or near the second end, a lumen in the first length, a flat length of bendable metal within the lumen in the first length which allows the closed flat loop to retain a desired shape, the closed flat loop having a length which is slightly longer than half the length of U.S. currency; (b) a second length of substantially non-stretchable material having a middle, a first end, a second end, and a lumen, the first end and the second end secured to the first length of substantially non-stretchable material, thereby forming a second flat loop slightly wider than the width of U.S. currency, the middle secured to a point on the first length (a) to maintain the first flat loop perpendicular to the second flat loop, the lumen in the second length containing a flat strip of bendable metal.

11 Claims, 10 Drawing Sheets

U.S. PATENT DOCUMENTS

| | | | |
|---|---|---|---|
| D467,069 | S | 12/2002 | TenHoeve |
| 6,708,375 | B1 | 3/2004 | Johnson |
| 6,871,682 | B2 | 3/2005 | Hogganvik |
| 7,148,796 | B2 | 12/2006 | Joy et al. |
| 2002/0194711 | A1 | 12/2002 | Stampler |

ARTICLE FOR HOLDING CURRENCY AND CREDIT CARDS

CROSS-REFERENCE TO RELATED APPLICATIONS

This application claims priority under 35 U.S.C. 365(a) from International Application PCT/US07/81050, filed Oct. 11, 2007.

BACKGROUND OF THE INVENTION

This invention relates to wallets, more particularly to wallets for holding, handling, and securing currency, credit cards, business cards, and the like.

Wallets in various sizes, shapes, and designs have been used in the past and are currently being used, each having its advantages and disadvantages, and are purchased by individuals based on their own personal preferences in terms of size, shape, weight, durability, functionality, utility, quality, image, brand name, price, and design appearance. Some people prefer a money clip rather than a large leather wallet because they do wish to carry a bulky article in their pocket. However, money clips have some disadvantages, for example they are not usually designed to carry credit cards and business cards in addition to currency.

U.S. Pat. No. 6,708,375 to Johnson disclosed a pocket-sized wallet comprising a first loop comprising elastic material attached to a second loop comprising elastic material at two opposing points on the loop to form a volume bounded by the first loop and the second loop to form a harness for carrying cards and/or folded currency in which a first pair of opposed edges of the cards and/or folded paper is contacted by the first loop and a second pair of opposed edges of the cards and/or folded currency is contacted by the second loop, and a key ring attached to one of the loops.

Others have proposed various alternative designs, but none has disclosed a wallet which is not only easy to carry but securing fits comfortably in a pocket and is very easy and efficient to use.

It is an object of the present invention to provide a wallet which is extremely easy to carry, holds contents securely, fits comfortably in a pocket, and is very easy and efficient to use.

SUMMARY OF THE INVENTION

These objects, and others as will become apparent from the following disclosure, are achieved by the present invention which comprises in one aspect an article for holding currency and credit cards comprising (a) a first length of substantially non-stretchable material having a first end and a second end configured to form a closed flat loop when the first end is retained on or near the second end, a first lumen in the first length, a flat length of bendable metal within the first lumen in the first length which allows the closed flat loop to retain a desired shape, the closed flat loop having a length which is slightly longer than half the length of paper currency; and (b) a second length of substantially non-stretchable material having a middle, a first end, a second end, and a second lumen, the first end and the second end secured to the first length of substantially non-stretchable material, thereby forming a second flat loop slightly wider than the width of paper currency, the middle secured to a point on the first length (a) to maintain the first flat loop perpendicular to the second flat loop, the second lumen in the second length containing a flat strip of bendable metal. By "paper currency" is meant current U.S. currency.

A finger-sized loop (c) formed of substantially non-stretchable material and secured to the second flat loop (b) is optional.

The article of the invention is easy to carry and fits comfortably in a pocket. The criss-cross design firmly secures the contents, reduces bulk, and enables very easy access to the contents. The vertical and horizontal bendable metal strip inserts increase the durability while reducing bulk. They also provide flexibility and mold the loops to the contents, firmly securing varying amounts and thicknesses of currency or other contents. The added structure versus comparable prior art articles allows easy access to contents and facilitates the process of taking bills in and out of the holder.

In some embodiments a magnetized adjustable closing mechanism where a magnet secures an end of the vertical strip to a metal containing portion of the vertical strip is used. The second end of the first length preferably comprises such magnet, and the second end is placed at some point on the first length where a metal strip is in a lumen. Alternatively a clasp can be used if a magnet is not desired.

The non-stretchable material is preferably fabric or leather but can be of other materials or combinations of materials such as part fabric and part leather.

The second length is preferably attached to the first length, for example with a rivet or by sewing, and usually but not necessarily the middle of the second length.

A credit card/business card retaining loop (d) is optional but preferred, and such credit card/business card loop can be secured to the first flat loop which is designed to hold currency. The credit card/business card retaining loop is preferably formed from a length of substantially non-stretchable material and a length of stretchable elastic material and is preferably rotatably secured to the first flat loop (a). It is also preferred that the credit card/business card retaining loop have a lumen in the substantially non-stretchable material and that the lumen contain a strip of flat metal. This loop preferably slightly wider than the width of a business card and/or credit card. In embodiments where this loop comprises an elastic member, this loop facilitates access to the contents and the actual process of handling the contents. It provides flexibility and allows the holder to remove or add contents of various amounts, whether one card or many. When this loop is rotating and includes the elastic, it allows the holder to separate currency from credit cards and business cards. It also adds security and reduces chances of losing contents since the rotating mechanism provides easy access to credit cards by providing clearance from bill.

The optional finger loop (d) may provide additional leverage to handle or stretch the holder. It also facilitates the handling of the holder while accessing contents and thereby frees up both hands to exchange contents.

BRIEF DESCRIPTION OF DRAWINGS

Various preferred embodiments of the invention will be described below with reference to the drawings in which FIG. 1 a front perspective view of an embodiment of a wallet article of the present invention.

DETAILED DESCRIPTION

Figure 1:
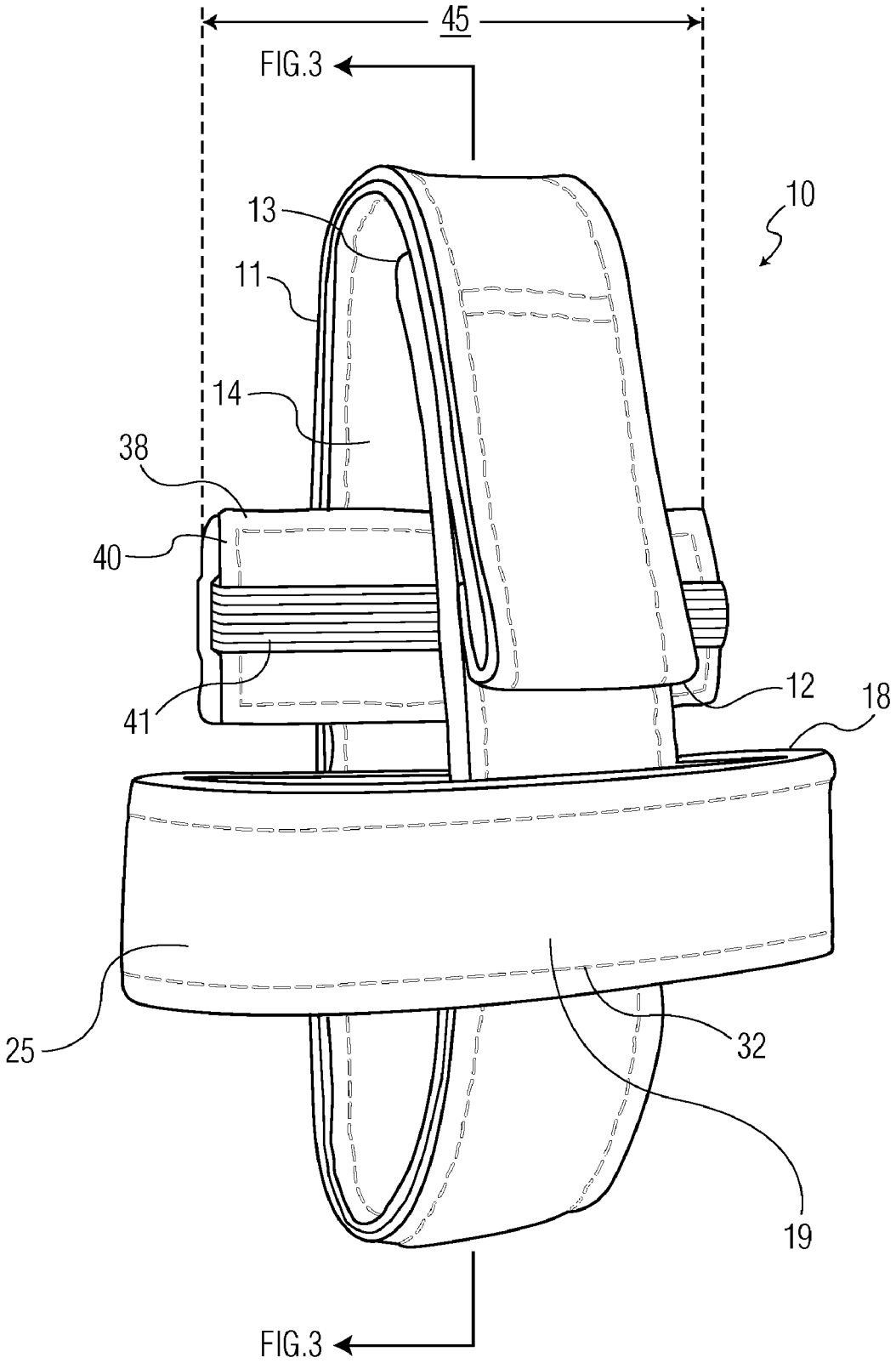

Referring now to the drawings, FIG. 1 is a front perspective view illustrating an embodiment of a wallet 10 with a first length 11 of substantially non-stretchable material having a first end 12 and a second end 13 configured to form a closed flat loop 14 when the first end 12 is retained on or near the second end 13, a lumen 46 in the first length 11, a flat length 29 of bendable metal within the lumen 46 which allows the closed flat loop 14 to retain a desired shape, the closed flat loop 14 having a length 15 which is slightly longer than half 16 the length of paper currency; a second length 18 of substantially non-stretchable material having a middle 19, a first end 20, a second end 21, and a lumen 22, the first end 20 and the second end 21 secured 23, 24 respectively, to the first length 11 of substantially non-stretchable material, thereby forming a second flat loop 25 slightly wider 26 than the width 27 of paper currency.

Figure 2:
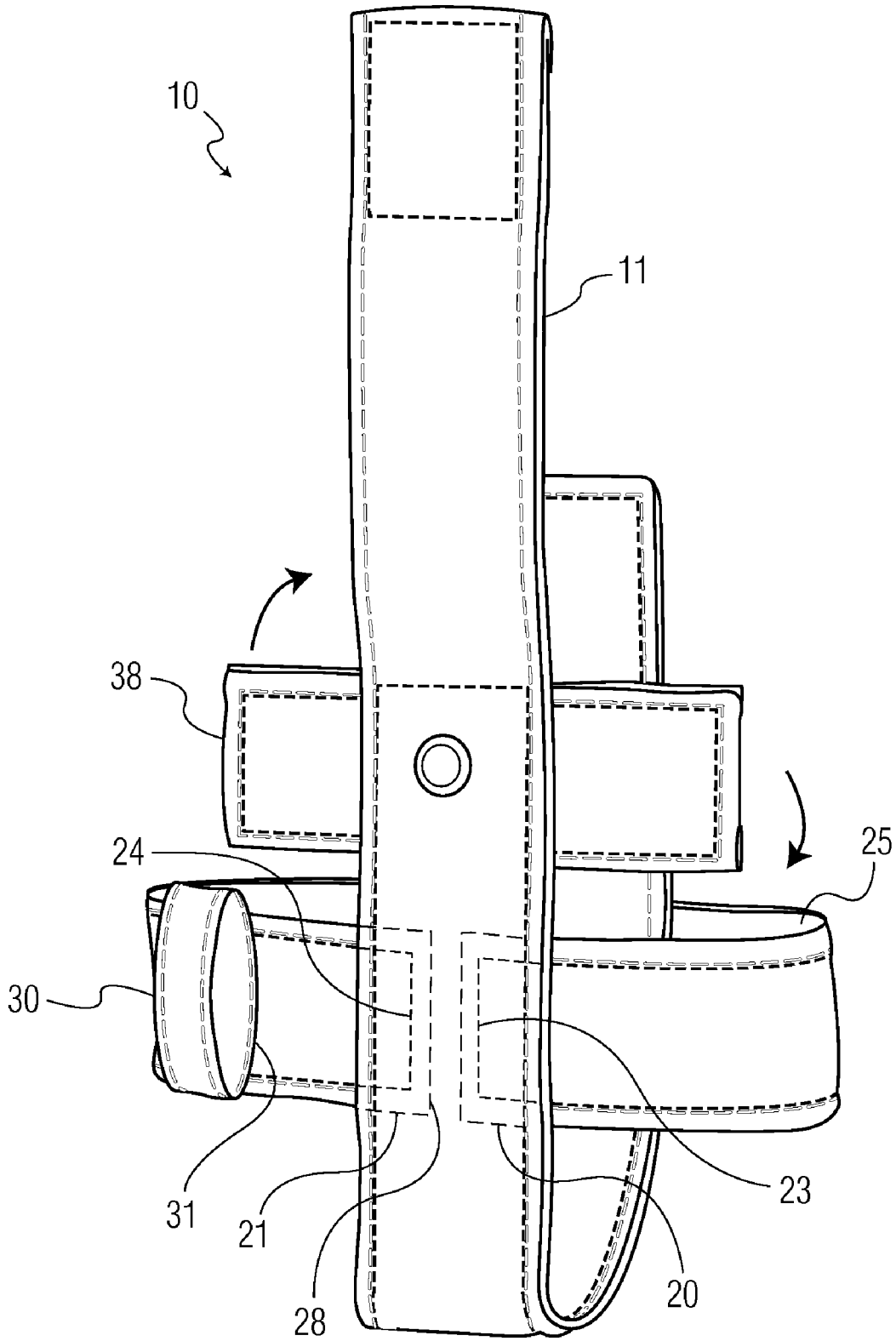
FIG. 2 is a front perspective view of a wallet of the invention with the first loop open.

Referring to FIG. 2, the middle of loop 25 is secured to a point 28 on the first length 11 to maintain the first flat loop 14 perpendicular to the second flat loop 25, the lumen 22 containing a flat strip 44 of bendable metal; and an optional finger-sized loop 30 formed of substantially non-stretchable material and secured 31 to the second flat loop 25.

Figure 3A:
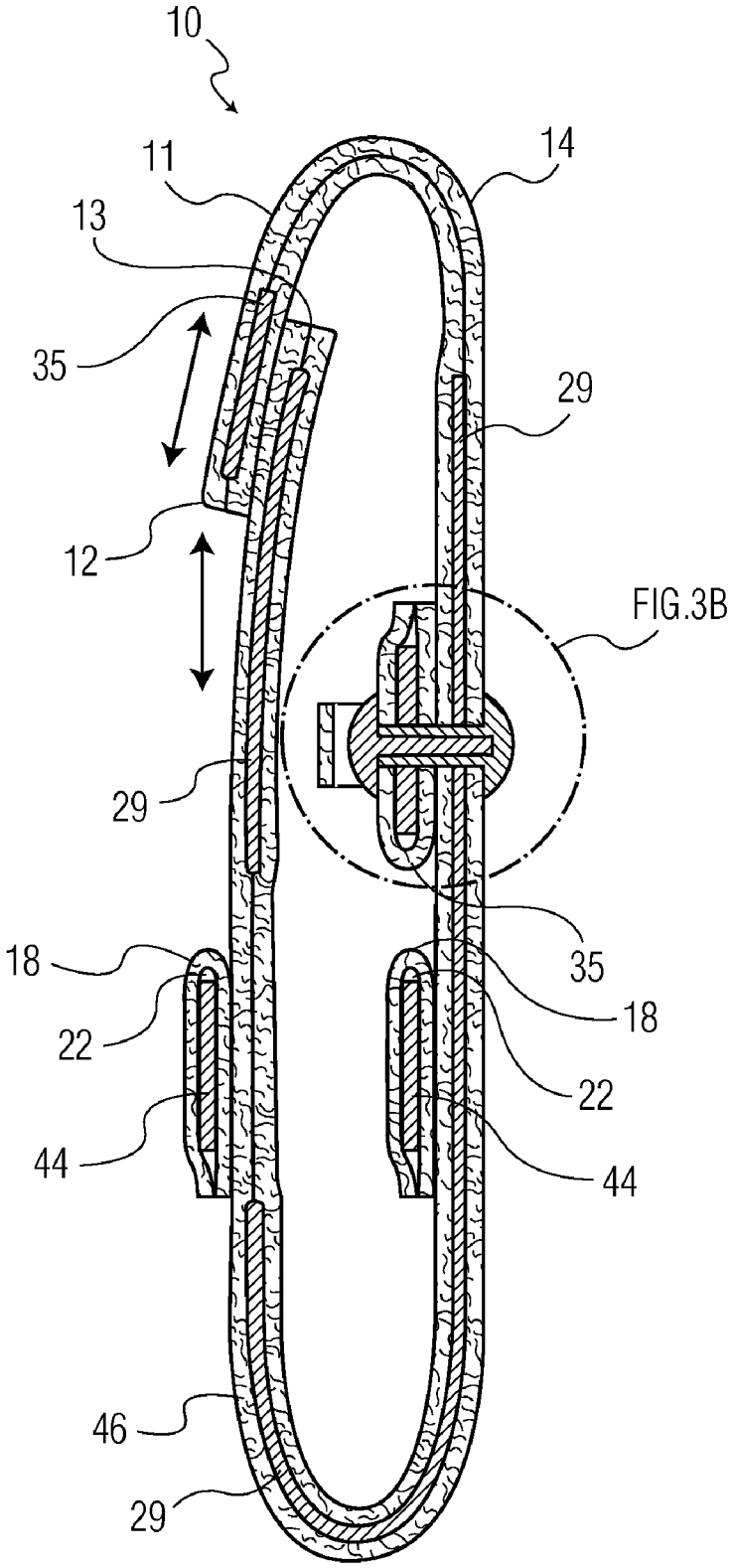
FIG. 3 is a side cross-sectional view through 3-3 of FIG. 2.
FIG. 3B is an enlarged cross-sectional view of an area of FIG. 3 where the credit/business card retaining loop is rotatably attached to the first loop with a rivet.
FIG. 3C is a side cross-sectional view of a wallet of the invention, similar to FIG. 3A except with folded currency illustrated.
FIG. 3D is a side cross-sectional view of a wallet of the invention, similar to FIG. 3A with more currency illustrated.

Referring to FIG. 3A, a side cross-sectional view through 3-3 of FIG. 2 is shown wherein first length 11 having first end 12 with magnet 35 at or near the first end, and second end 13 having a lumen with flat strip 29 of metal inside. Second length 18 is shown with metal strip 22 inside. Metal strip 29 is in lumen 46 of first length 11.

Figure 3B:
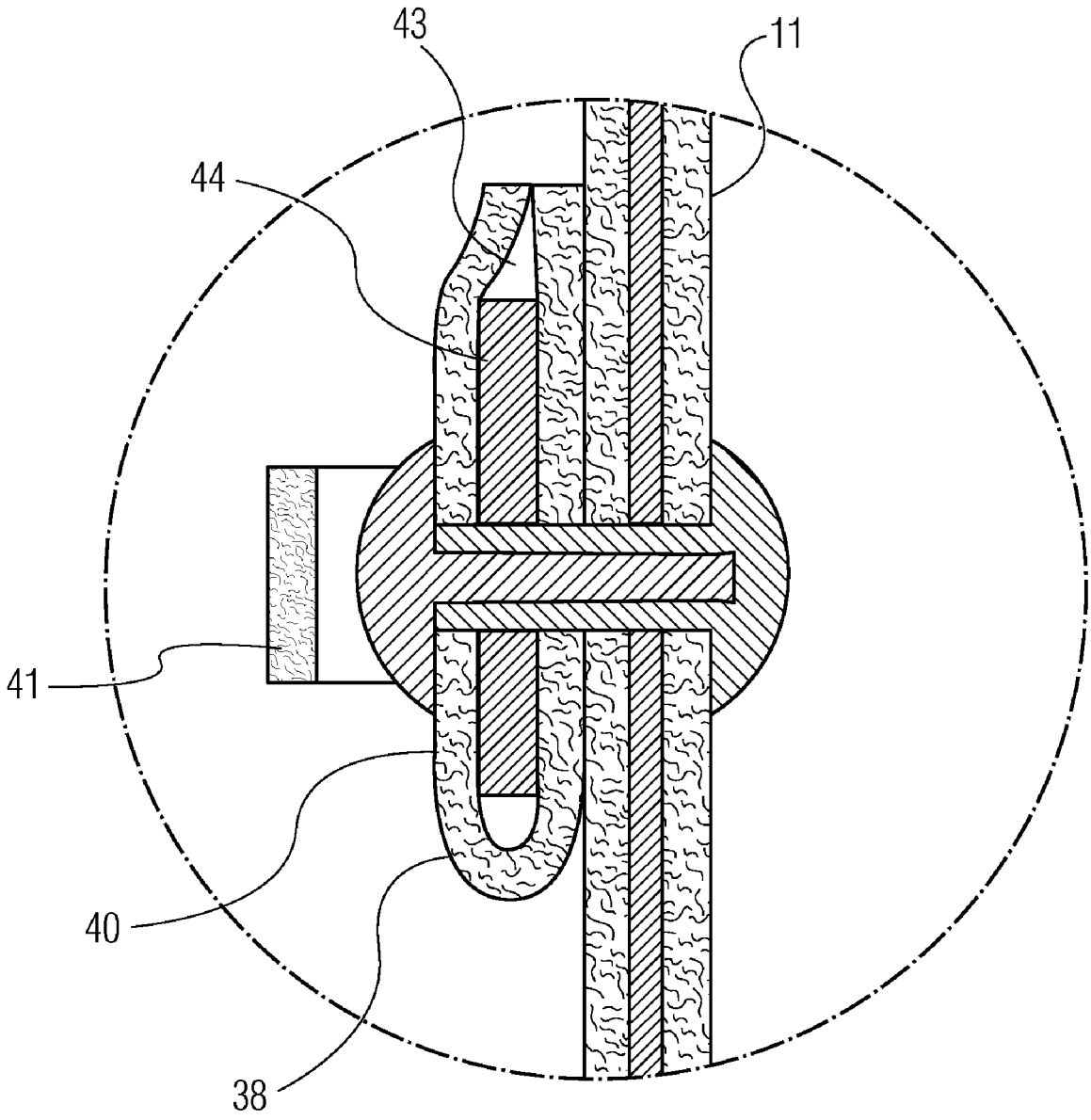

FIG. 3B is an enlarged cross-sectional view of an area of FIG. 3 where the credit/business card retaining loop 38 is rotatably attached to the first loop 11 with a rivet, and loop 38 is constructed of non-stretchable material 40 which has a lumen 43 with metal strip 44, and stretchable material 41.

Figure 3C:
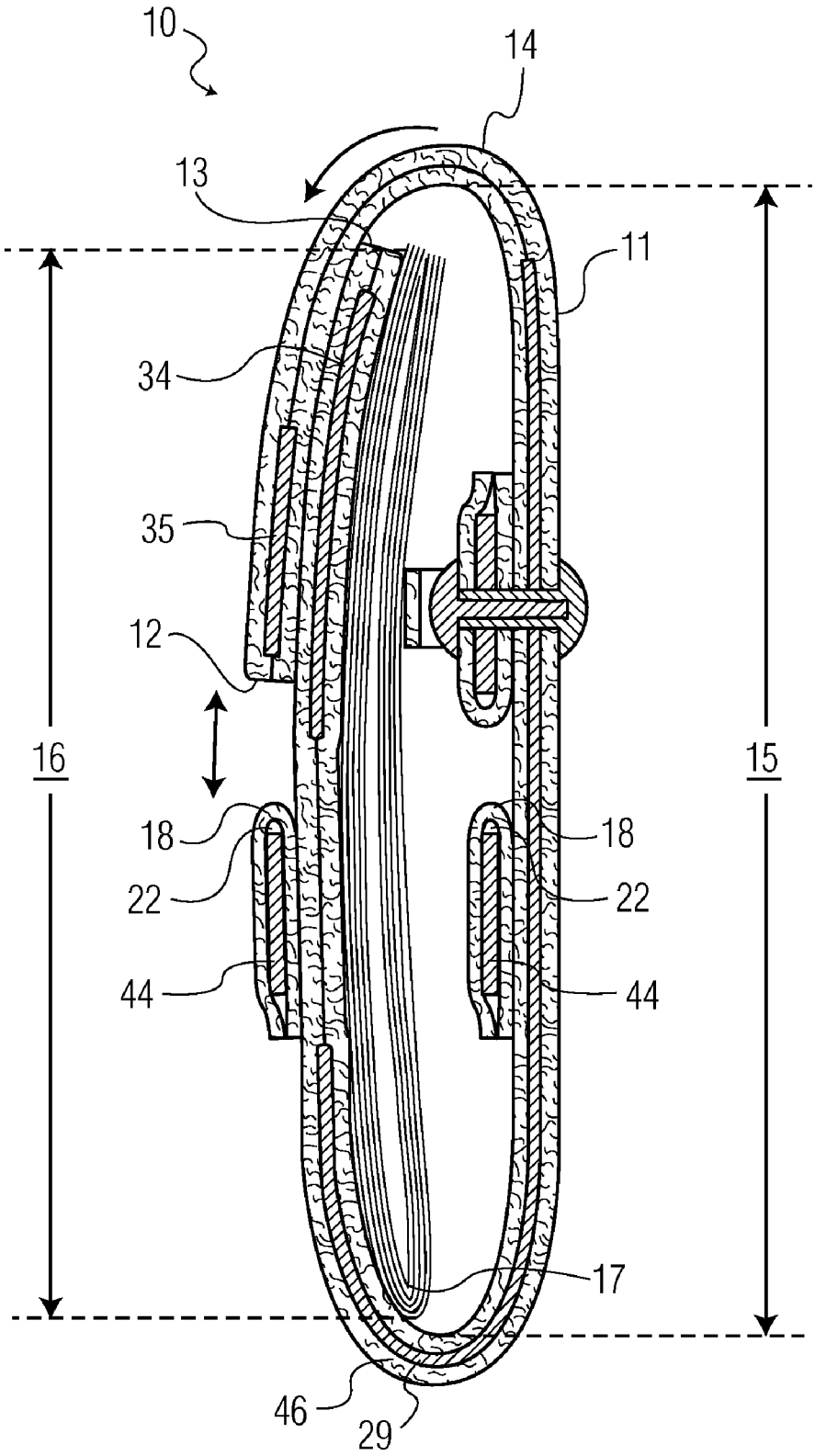

FIG. 3C illustrates the placement of folded 17 currency 16 within the first loop 11. First vertical loop 11 is opened by removing first end 12 from second end 13, which is normally held in place by the magnetic attraction between magnet 35 and flat length of metal 34. The flat lengths of metal 34 and 44 bend to accommodate the amount of currency or other materials within the loops 11 and 18.

Figure 3D:
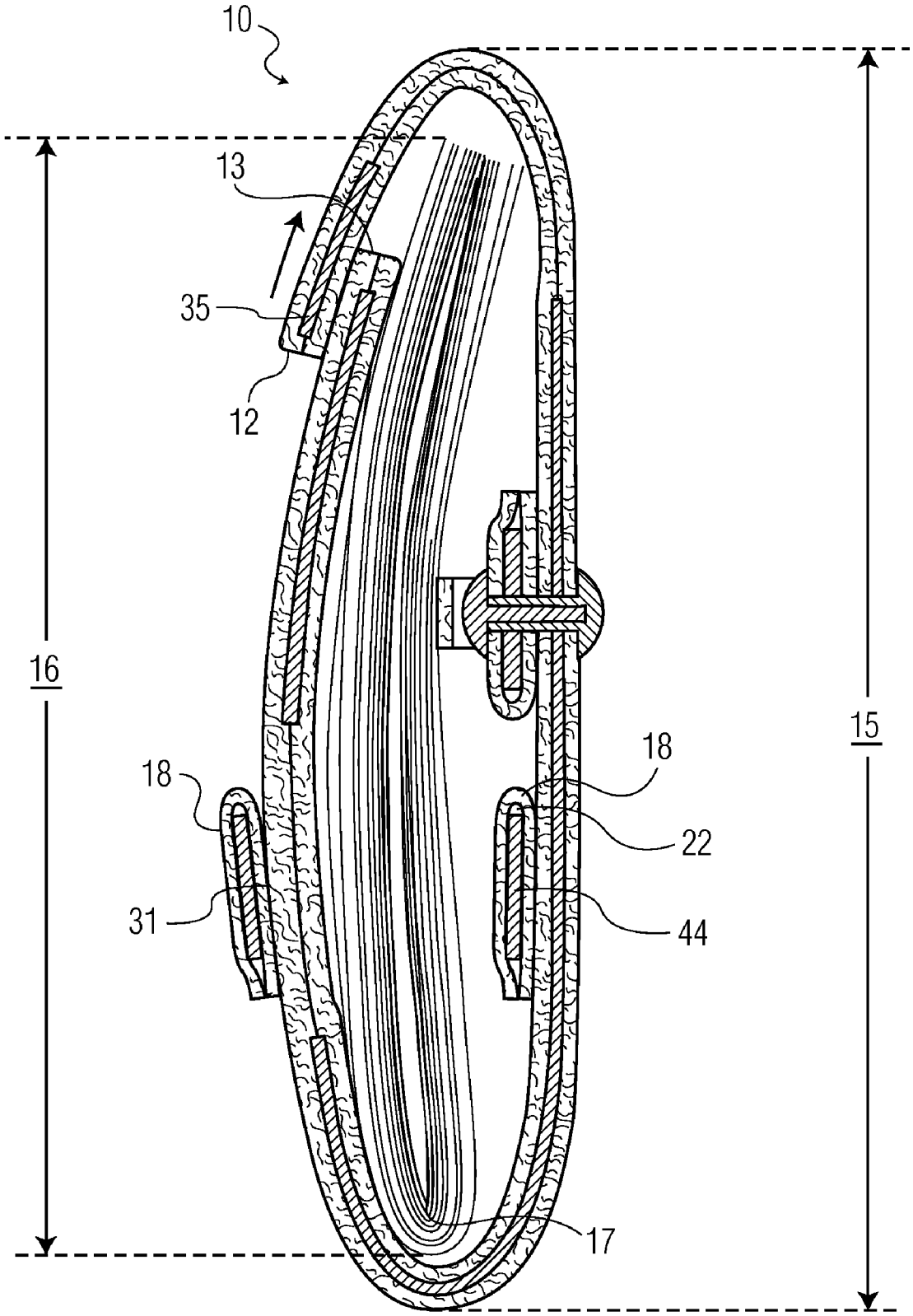

FIG. 3D illustrates the wallet 10 holding a larger amount of currency than shown in FIG. 3C. One advantage of the invention is the convenient expansion feature where the magnet 35 containing end 12 can be placed at any place on second end 13 to maintain the first loop closed regardless of how much currency or other paper it contains. The flat lengths of metal 34 and 44 bend to accommodate the amount of currency or other materials within the loops 11 and 18.

Figure 4:
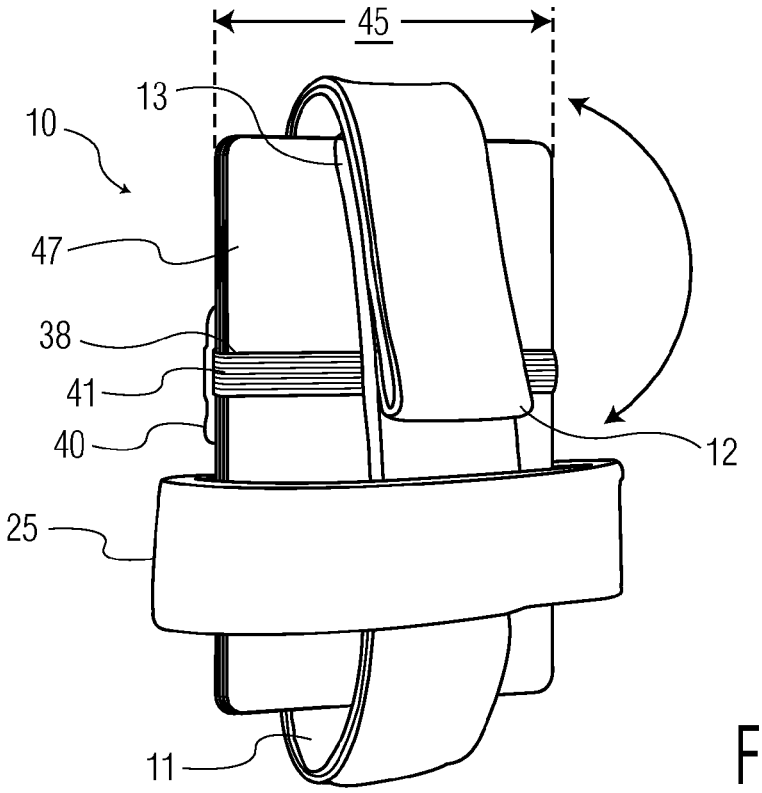
FIG. 4 is a front perspective view of a wallet of the invention with business or credit card retained in the business/credit card loop.

FIG. 4 is a front perspective view of a wallet 10 of the invention with a few business or credit cards 47 retained in the business/credit card loop by the length of stretchable material 41.

Figure 5:
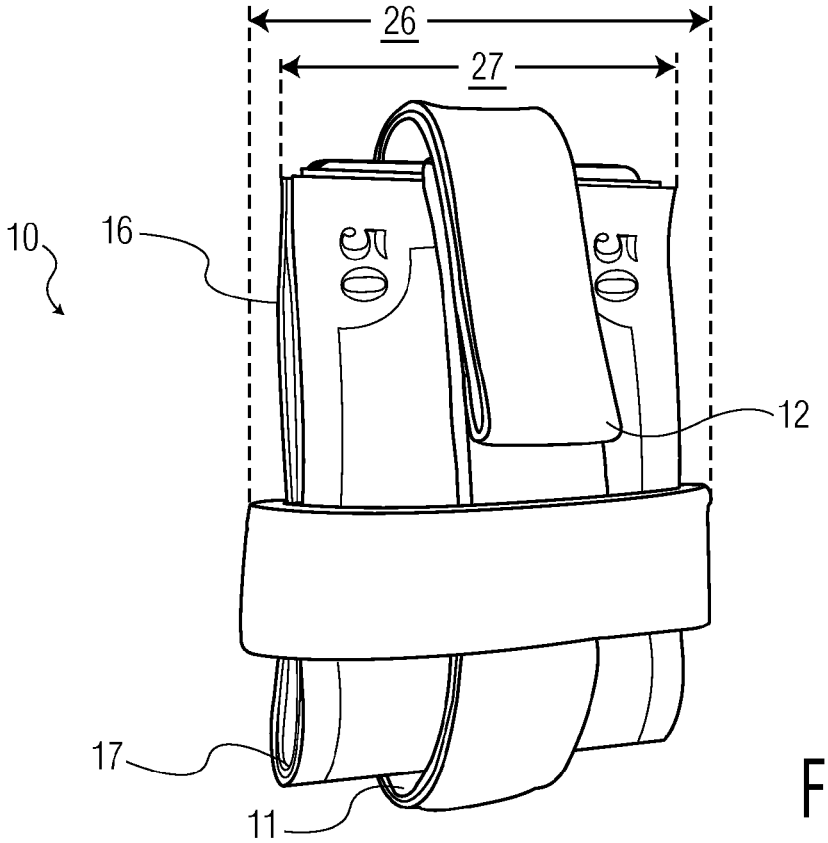
FIG. 5 is a front perspective view of an article according to the invention with currency in the first loop.

FIG. 5 is a front perspective view of the wallet 10 according to the invention with currency 16 in the first loop of non-stretchable material 11, illustrating fold 17 in the currency at the bottom of first loop 11.

Figure 6:
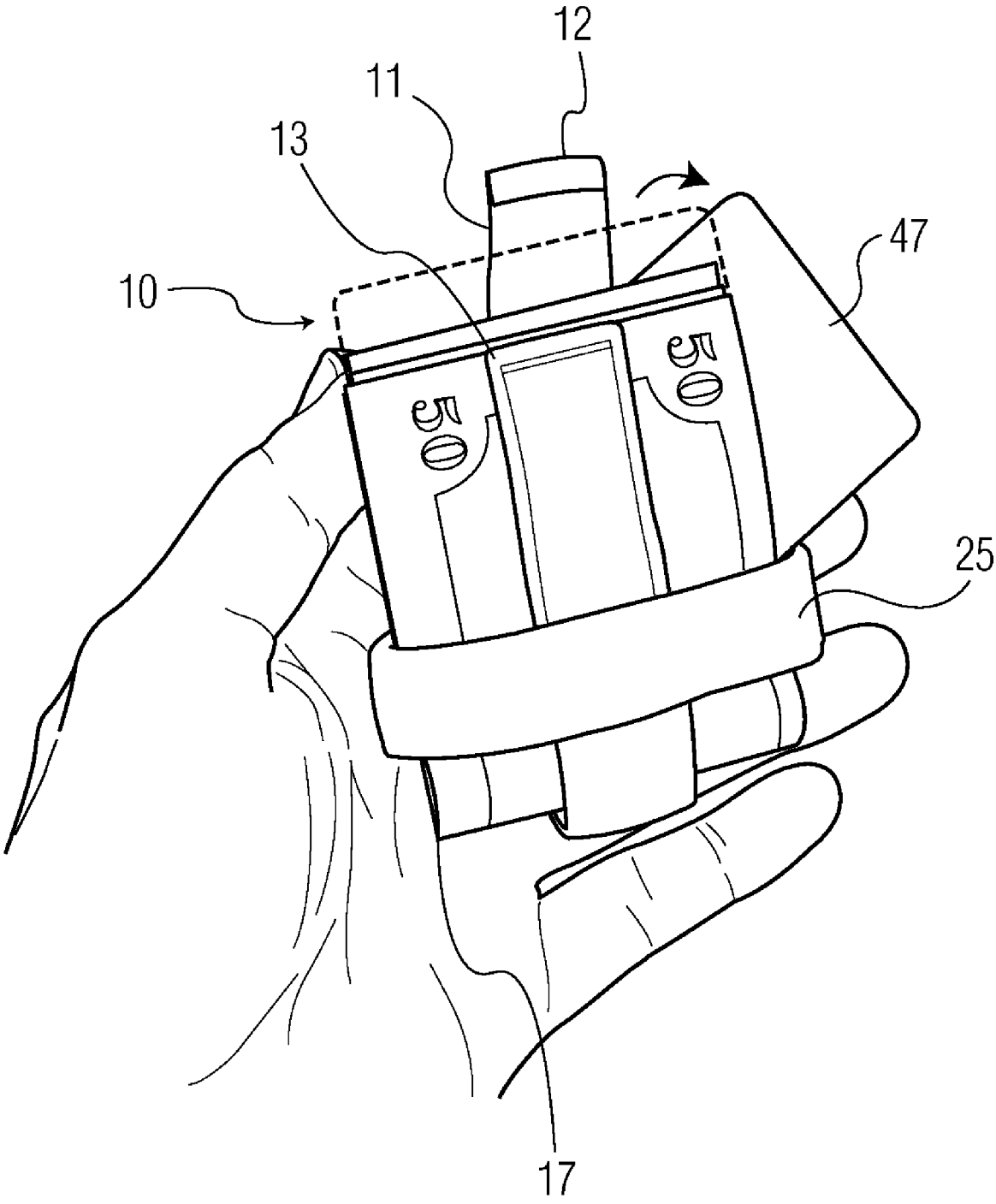
FIG. 6 is a front perspective view of a wallet according to the invention illustrating currency and illustrating business or credit card being removed with one hand in a clockwise direction, with the first end of the first loop opened.

FIG. 6 is a front perspective view of a wallet 10 according to the invention illustrating currency 16 and illustrating business or credit card being removed with one hand in a clockwise direction, with the first end 12 of the first loop 11 opened.

Figure 7:
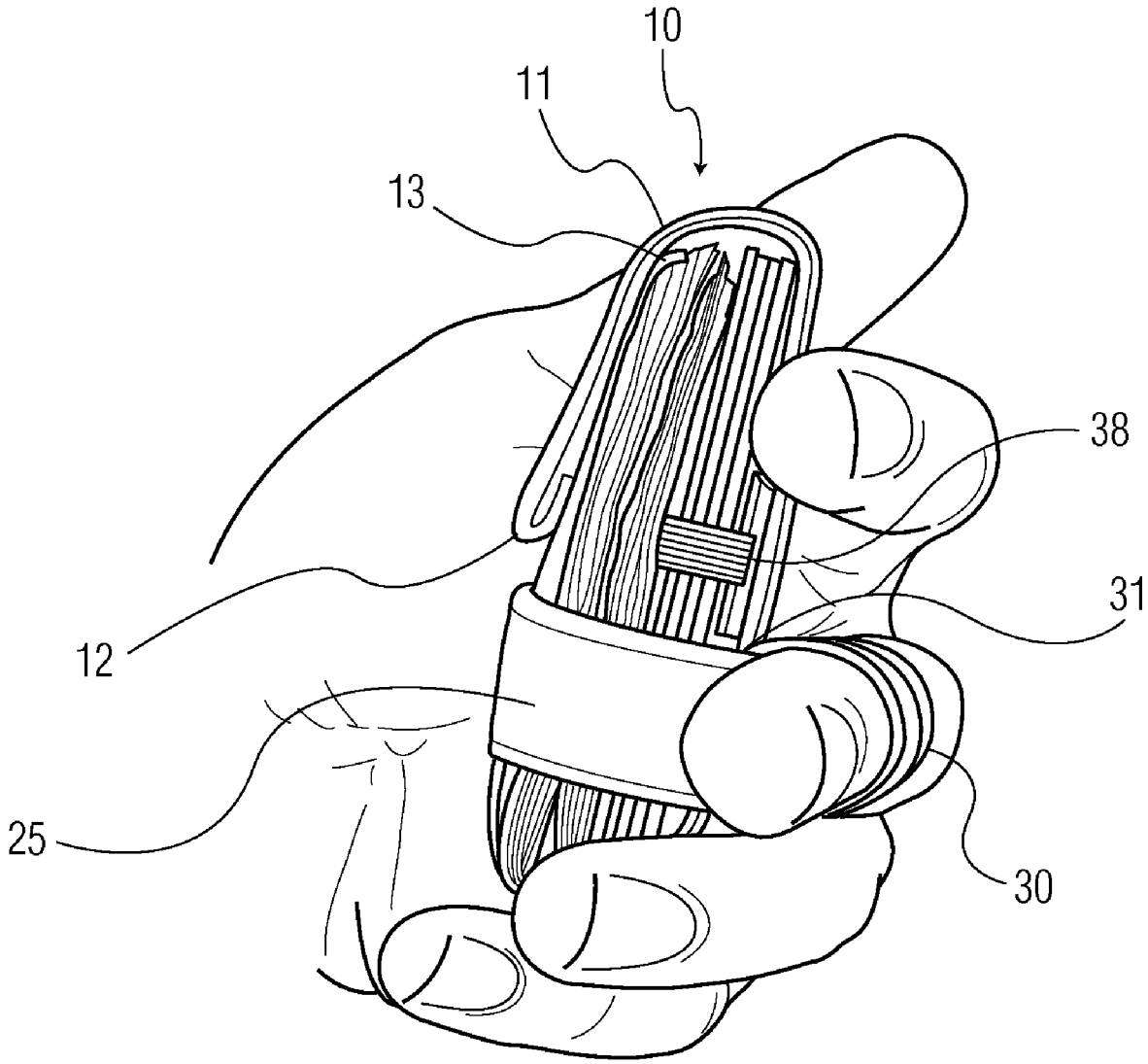
FIG. 7 is a side perspective view of a wallet according to the invention with currency, cards, and middle finger in the optional finger-sized loop illustrated.

FIG. 7 is a side perspective view of a wallet 10 according to the invention with currency, cards, and middle finger in the loop illustrated. The optional middle finger loop 30 in some embodiments helps the holder to utilize the adjustable features and may provide additional leverage if needed to handle or stretch the wallet 10 and also to facilitate the handling of the wallet 10 while accessing its contents, freeing up both hands to exchange contents.

Figure 8:
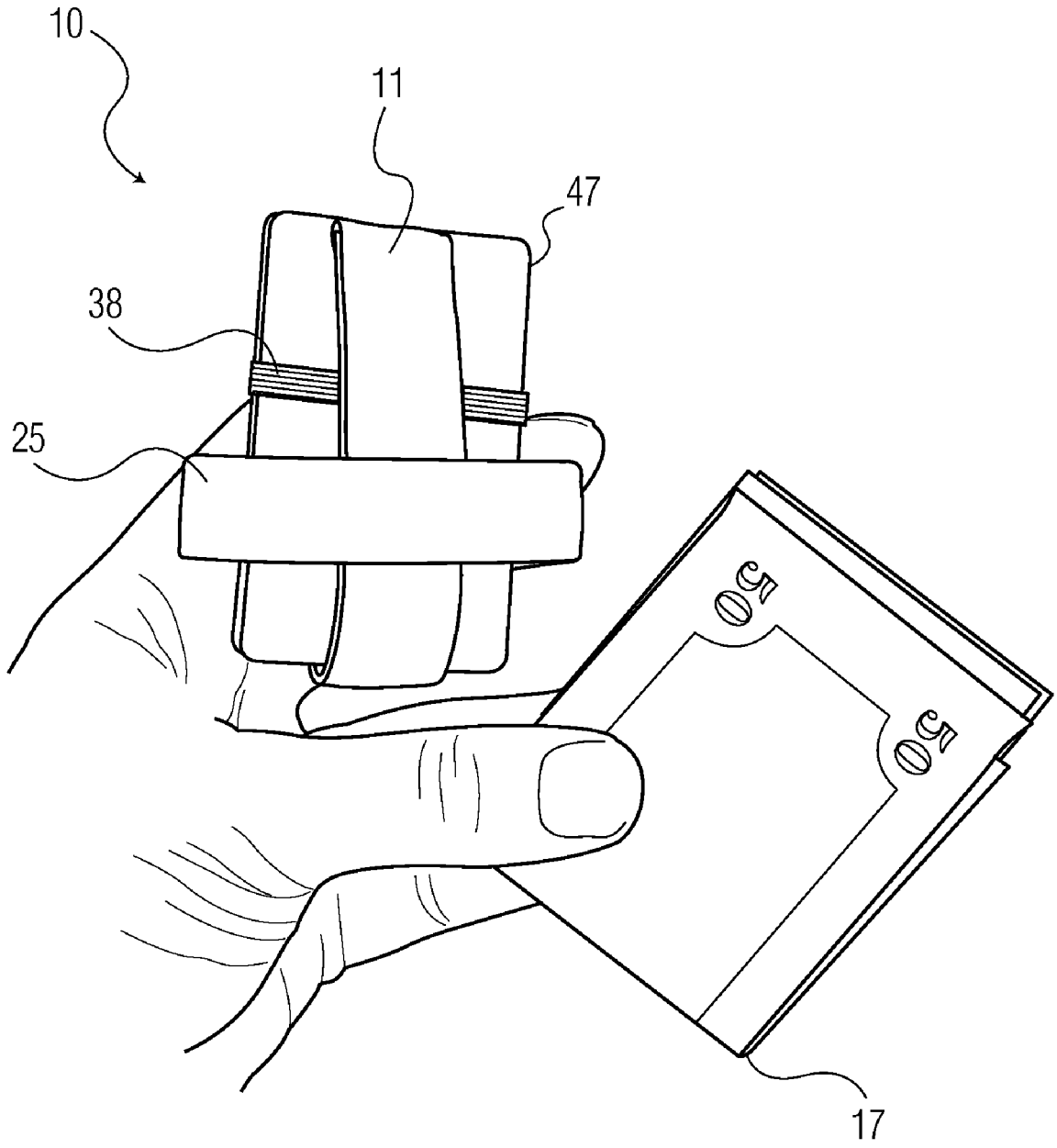
FIG. 8 is a front perspective view of a wallet according to the invention illustrating currency being removed with one hand.

FIG. 8 is a front perspective view of a wallet 10 according to the invention illustrating currency 17 being removed with one hand.

While the invention has been described and illustrated in detail herein, various alternative embodiments should become apparent to those skilled in this art without departing from the spirit and scope of the invention.

What is claimed is:

1. An article for holding currency and credit cards comprising (a) a first length of substantially non-stretchable material having a first end and a second end configured to form a closed flat loop when the first end is retained on or near the second end, a first lumen in the first length, a flat length of bendable metal within the first lumen in the first length which allows the closed flat loop to retain a desired shape, the closed flat loop having a length which is slightly longer than half the length of paper currency; and (b) a second length of substantially non-stretchable material having a middle, a first end, a second end, and a second lumen in the second length, the first end and the second end secured to the first length of substantially non-stretchable material, thereby forming a second flat loop slightly wider than the width of paper currency, the middle secured to a point on the first length (a) to maintain the first flat loop perpendicular to the second flat loop, the second lumen in the second length containing a flat strip of bendable metal.

2. The article of claim 1, further including (c) a finger-sized loop formed of substantially non-stretchable material and secured to the second flat loop (b).

3. The article of claim 1 wherein the non-stretchable material is fabric or leather.

4. The article of claim 1 wherein the middle of the second length is attached to a point on the first length.

5. The article of claim 1 wherein the second end of the first length (a) comprises a magnet.

6. The article of claim 1 wherein the means to retain the first end on or near the second end of the first length (a) is a clasp.

7. The article of claim 1 further including (d) a credit card and business card retaining loop secured to the first flat loop (a).

8. The article of claim 1 further including (d) a credit card and business card retaining loop secured to the first flat loop (a) formed from a length of substantially non-stretchable material and a length of stretchable elastic material.

9. The article of claim 1 further including (d) a credit card and business card retaining loop rotatably secured to the first flat loop (a) formed from a length of substantially non-stretchable material and a length of stretchable elastic material.

10. The article of claim 1 further including (d) a credit card and business card retaining loop secured to the first flat loop (a) formed from and a length of stretchable elastic material and a length of substantially non-stretchable material having a lumen containing a strip of flat metal.

11. The article of claim 1 further including (d) a credit card and business card retaining loop secured to the first flat loop (a) formed from a length of substantially non-stretchable material and a length of stretchable elastic material, wherein the business or credit card retaining loop (d) is slightly wider than the width of a business card and/or credit card.

* * * * *